US009377747B1

(12) United States Patent
Matsuno

(10) Patent No.: US 9,377,747 B1
(45) Date of Patent: Jun. 28, 2016

(54) MEMBER MOVING MECHANISM AND IMAGE FORMING APPARATUS INCLUDING SAME

(71) Applicant: KYOCERA Document Solutions Inc., Osaka (JP)

(72) Inventor: Akinori Matsuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/092,162

(22) Filed: Apr. 6, 2016

Related U.S. Application Data

(62) Division of application No. 14/283,100, filed on May 20, 2014, now Pat. No. 9,335,715.

(30) Foreign Application Priority Data

May 22, 2013 (JP) ..... 2013-107643

(51) Int. Cl.
*G03G 21/16* (2006.01)

(52) U.S. Cl.
CPC ..... *G03G 21/1619* (2013.01); *G03G 2221/166* (2013.01)

(58) Field of Classification Search
CPC ..... G03G 21/1619; G03G 21/1623; G03G 21/1642; G03G 21/1647; G03G 2221/166; G03G 2221/1657
See application file for complete search history.

(56) References Cited

U.S. PATENT DOCUMENTS

| | | | | |
|---|---|---|---|---|
| 2009/0022514 | A1 | 1/2009 | Fujiwara | 399/121 |
| 2010/0097745 | A1 * | 4/2010 | Saitou | G03G 15/16 361/679.01 |
| 2014/0029997 | A1 | 1/2014 | Tsuchiya | 399/397 |

FOREIGN PATENT DOCUMENTS

| | | | |
|---|---|---|---|
| EP | 2 645 185 | A2 | 10/2013 |
| JP | 8-30166 | A | 2/1996 |
| JP | 2002-351286 | A | 12/2002 |
| JP | 2011-70154 | A | 4/2011 |
| JP | 2011-232501 | A | 11/2011 |

* cited by examiner

*Primary Examiner* — Joseph S Wong
(74) *Attorney, Agent, or Firm* — Stein IP, LLC

(57) ABSTRACT

A member moving mechanism includes a moving member, a moved member, a belt member, an openable-closable cover that is rotatable about a rotation shaft with the openable-closable cover engaged with the moving member, and a first biasing member. The moving member moves in a first negative direction with a biasing force of the first biasing member when the openable-closable cover rotates in an opening direction, while the moving member moves in a first positive direction against the biasing force of the first biasing member when the openable-closable cover rotates in a closing direction. The moving member has a boss formed to abut a first-positive-direction side of the engaging piece projecting from the rotation shaft. A biasing force in the opening direction is applied to the openable-closable cover by the boss pressing the engaging piece in the first negative direction with the biasing force of the first biasing member.

5 Claims, 13 Drawing Sheets

MEMBER MOVING MECHANISM AND IMAGE FORMING APPARATUS INCLUDING SAME

INCORPORATION BY REFERENCE

This application is a divisional application of U.S. application Ser. No. 14/283,100, filed May 20, 2014 in the U.S. Patent and Trademark Office, which is based upon and claims the benefit of priority from the corresponding Japanese Patent Application No. 2013-107643 filed on May 22, 2013, the entire contents of which are incorporated herein by reference.

BACKGROUND

The present disclosure relates to a member moving mechanism that connects two members and that, by moving one member, causes the other member to move, and to image forming apparatuses, such as copiers and printers, that include such a member moving mechanism.

Some image forming apparatuses such as printers have a mechanism (member moving mechanism) in which a member provided inside a cabinet of an image forming apparatus is moved in conjunction with opening of a cover member. In such a member moving mechanism, a link or a wire is used as a connecting member for connecting two members. With such a member moving mechanism, it is possible to move one member so as to cause the other member to move via the connecting member.

A known example of such a member moving mechanism employs a belt member to connect first and second moving members designed to reciprocate in different directions and is also provided with a guide member for guiding the belt member such that a moving direction of the belt member is changed at least once, and thereby, it is possible to dispose the belt member as the connecting member with a higher degree of freedom and to facilitate the assembly of the member moving mechanism.

SUMMARY

According to one aspect of the present disclosure, a member moving mechanism includes a moving member, a moved member, a belt member, a belt-member guide member, an openable-closable cover, and a first biasing member. The moving member is movable in a first positive direction and a first negative direction that is opposite to the first positive direction. The moved member moves in a second positive direction that is different from both the first positive and negative directions in conjunction with movement of the moving member in the first positive direction, and the moved member moves in a second negative direction that is opposite to the second positive direction in conjunction with movement of the moving member in the first negative direction. The belt member connects the moving member to the moved member. The belt-member guide member regulates a moving direction of the belt member. The openable-closable cover is rotatable about a rotation shaft in a state where the openable-closable cover is engaged with the moving member. The first biasing member biases the moved member in the second negative direction. When the openable-closable cover rotates in an opening direction, the moving member is caused to move in the first negative direction by the biasing force of the first biasing member, and when the openable-closable cover rotates in a closing direction, the moving member moves in the first positive direction against the biasing force of the first biasing member. The openable-closable cover has an engaging piece projecting from the rotation shaft, and the moving member has a boss abutting the engaging piece on a first-positive-direction side of the engaging piece. The boss applies a biasing force to the openable-closable cover in the opening direction by pressing the engaging piece in the first negative direction with the biasing force of the first biasing member.

Still other objects and specific advantages of the present disclosure will become apparent from the following descriptions of preferred embodiments.

DETAILED DESCRIPTION

Figure 1:
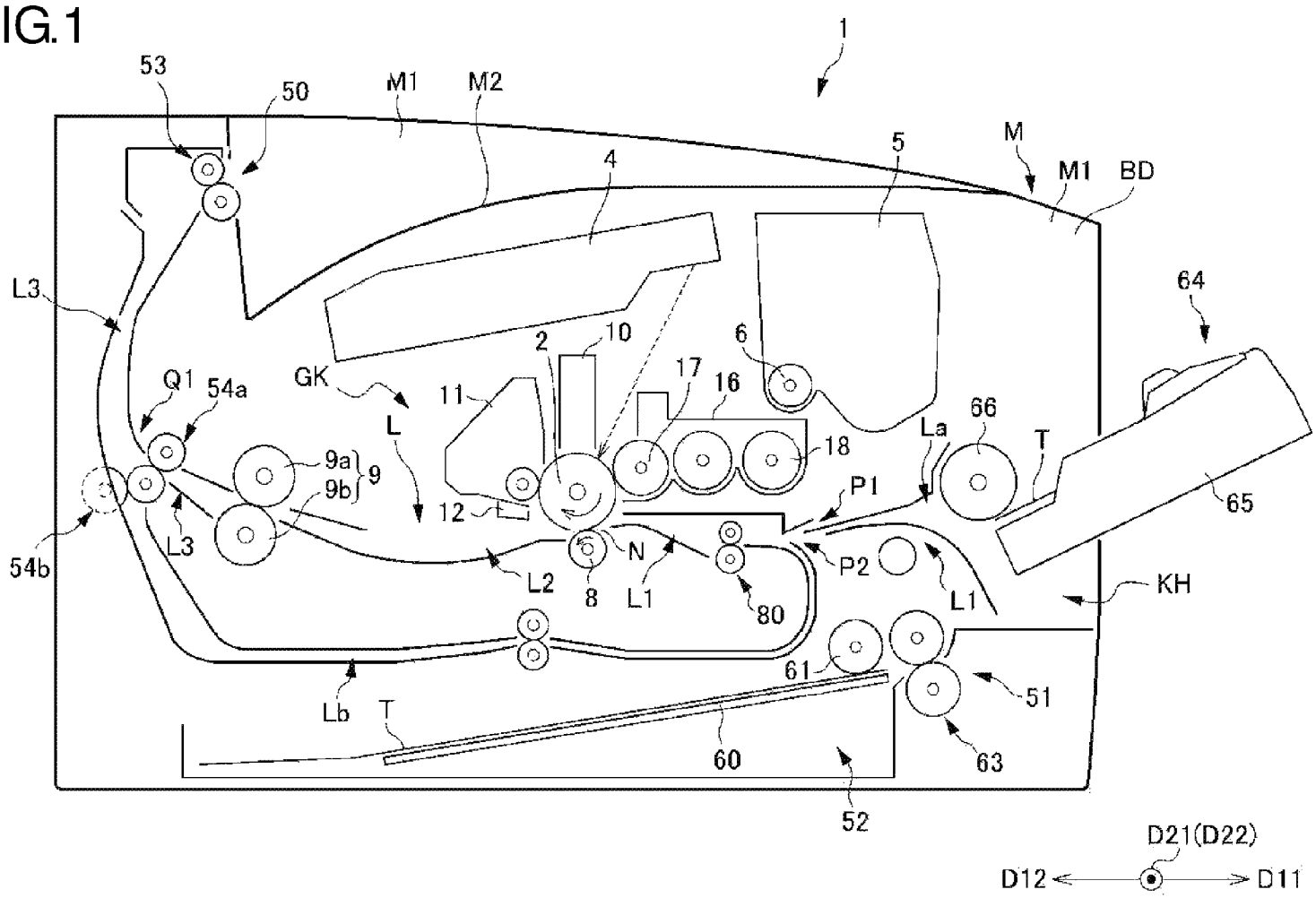
FIG. 1 is a schematic sectional view showing an internal structure of an image forming apparatus 1 including a member moving mechanism 100 of the present disclosure.

Hereinafter, embodiments of the present disclosure will be described with reference to the accompanying drawings. FIG. 1 is a schematic sectional view of an image forming apparatus 1 according to one embodiment of the present disclosure.

Figure 2:
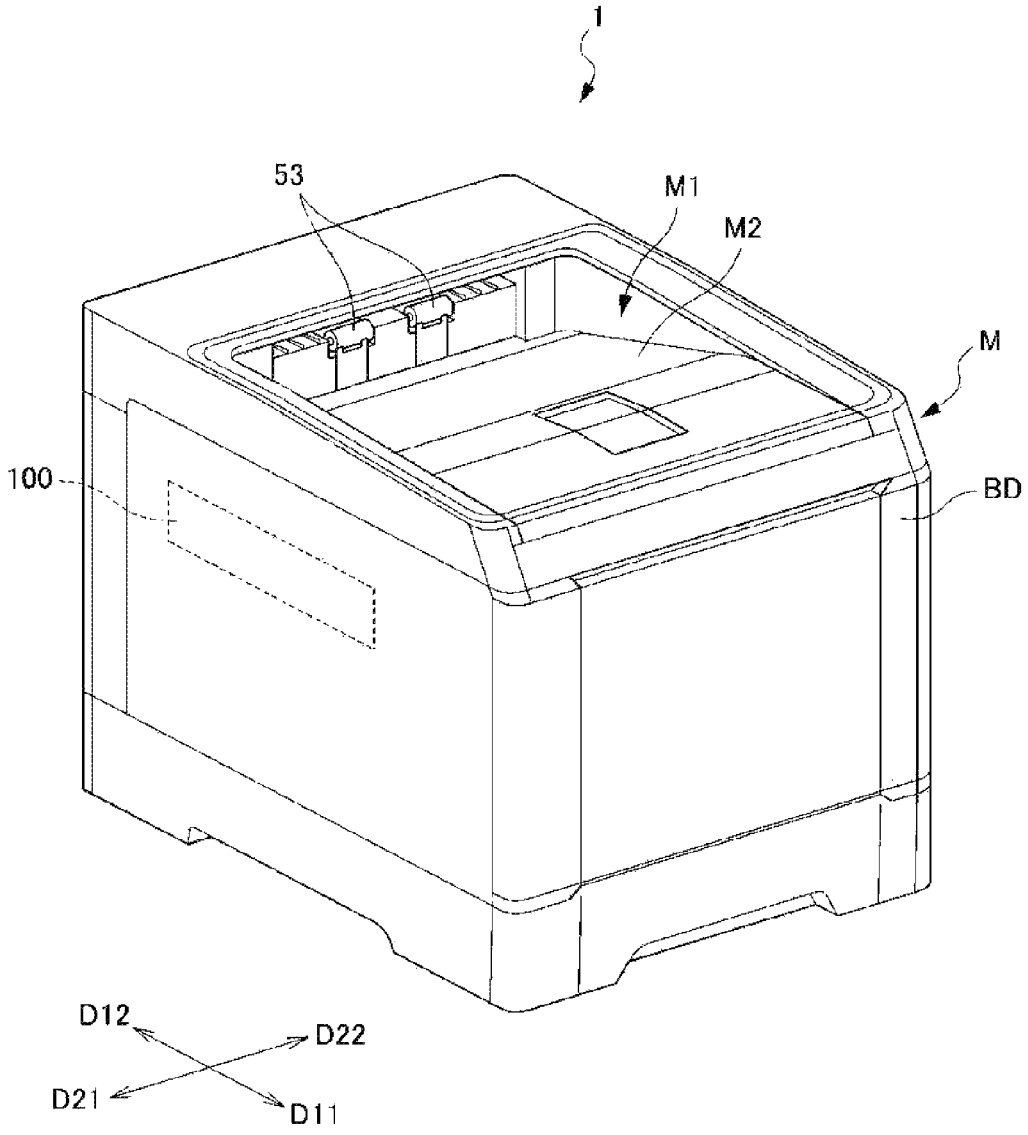
FIG. 2 is an exterior perspective view of the image forming apparatus 1 as seen from a side of a front face thereof.

FIG. 2 is an exterior perspective view showing the image forming apparatus 1 as seen from a side of a front face thereof (the left side of FIG. 1). Note that a monochrome printer is shown as the image forming apparatus 1 here. Note also that, for the convenience of the following description, a front-back direction of an apparatus main body M of the image forming apparatus 1 will be referred to as a first direction D1, a direction toward the front side of the apparatus main body M will be referred to as a first positive direction D11, and a backward direction will be referred to as a first negative direction D12. On the other hand, a direction perpendicular to the first direction D1 (a right-left direction of the apparatus main body M) will be referred to as a second direction D2, a direction toward the left side of the apparatus main body M will be referred to as a second positive direction D21, and a direction toward the right side of the apparatus main body M will be referred to as a second negative direction D22.

The image forming apparatus 1 includes the apparatus main body M, an image forming section GK that forms a predetermined toner image on paper T as a transfer material in the form of sheet based on predetermined image information, and a paper feeding/ejecting section KH that feeds the paper T to the image formation section GK and ejects the paper T after the toner image is formed on the paper T. The exterior shape of the apparatus main body M is constituted by a case body BD as a cabinet.

As shown in a FIG. 1, the image forming section GK includes, in addition to a photosensitive drum 2 as an image carrier (photosensitive body), a charging section 10, a laser scanner unit (LSU) 4 as an exposure unit, a developing device 16, a transfer roller 8, a neutralizer 12, and a drum cleaning section 11 that are arranged along the surface of the photosensitive drum 2 in order from upstream to downstream with respect to a rotation direction of the photosensitive drum 2. A fixing section 9 is disposed downstream from the image forming section GK with respect to a paper conveying direction. The paper feeding/ejecting section KH includes a paper cassette 52, a manual paper feeding section 64, a paper T conveying path L, a regist roller pair 80, and a paper ejecting section 50. Hereinafter, detailed descriptions will be given of the configurations of the image forming section GK and the paper feeding/ejecting section KH.

In the image forming section GK, charging by the charging section 10, exposure by the LSU 4, development by the developing device 16, transfer by the transfer roller 8, and neutralization by the neutralizer 12, and cleaning by the drum cleaning section 11 are sequentially performed in order with respect to the surface of the photosensitive drum 2.

The photosensitive drum 2 is configured with, for example, an aluminum drum element tube and a photosensitive layer laid thereon, and disposed to be rotatable in a direction indicated by an arrow about a shaft extending in a direction orthogonal to a direction in which paper T is conveyed through a paper conveying path L. The photosensitive drum 2 has its photosensitive layer charged by the charging section 10, which will be described later, and then, the photosensitive layer is irradiated with a laser beam from the LSU 4 such that an electrostatic latent image is formed through attenuation of electric charge. Preferred as the photosensitive layer is, for example, but not limited to, amorphous silicon (a-Si), which is high in durability, or an organic photosensitive layer (OPC), which produces little ozone in charging and contributes to a high-resolution image.

The charging section 10 is disposed to face the surface of the photosensitive drum 2, and uniformly charges the surface of the photosensitive drum 2 either negatively (negative polarity) or positively (positive polarity). The LSU 4 is disposed apart from the surface of the photosensitive drum 2, and includes a laser light source, a polygon mirror, a polygon mirror driving motor, and the like, none of which are illustrated in the drawings.

The developing device 16 causes toner to adhere to an electrostatic latent image formed on the photosensitive layer of the photosensitive drum 2 to form a toner image thereon, and is provided with, for example, a developing roller 17 that is disposed facing the surface of the photosensitive drum 2 and an agitating roller 18 for agitating toner. Toner is supplied to the developing device 16 from a toner cartridge 5 via a toner supply section 6. It should be noted that a single-component developer (henceforth referred to simply as toner as well) composed only of magnetic toner component is accommodated in the developing device 16.

The transfer roller 8 transfers the toner image formed on the surface of the photosensitive drum 2 onto a sheet of paper without disturbing the toner image. The sheet of paper is conveyed along the paper conveying path L to the transfer roller 8. An unillustrated transfer-bias applying section applies to the transfer roller 8 a transfer bias having a polarity opposite to that of the toner.

The neutralizer 12 is disposed to face the surface of the photosensitive drum 2. The neutralizer 12 irradiates the surface of the photosensitive drum 2 with light to thereby neutralize (neutralize electric charge of) the surface of the photosensitive drum 2 after the transfer of the toner image is performed by the transfer roller 8.

The cleaning section 11 is provided with, for example, a cleaning roller and a cleaning blade which are in linear contact with the photosensitive drum 2 along the longitudinal direction thereof. The cleaning section 11 removes attached matter remaining on the surface of the photosensitive drum 2, such as residual toner and toner external additives, after the toner image is transferred onto the paper T.

The fixing section 9 fixes the toner image on the paper T by melting, and applying pressure to, the toner of the toner image that has been transferred onto the paper T. The fixing section 9 is provided with a heating roller 9*a* to which heat is applied by a heater, and a pressing roller 9*b* that is pressed against the heating roller 9*a*. The paper T is conveyed while being nipped in a nip section (fixing nip section) between the heating roller 9*a* and the pressing roller 9*b*, and thereby the toner transferred onto the paper T is melted and pressed to be fixed on the paper T.

Next, a description will be given of the paper feeding/ejecting section KH. As shown in a FIG. 1, the paper cassette 52 for accommodating sheets of the paper T is disposed in a lower portion of the apparatus main body M. The paper cassette 52 is attached to be withdrawable in a horizontal direction from the front side of the apparatus main body M (the right side in FIG. 1). In the paper cassette 52, there is disposed a paper stacking plate 60 for stacking sheets of paper T thereon. The sheets of paper T accommodated in the paper cassette 52 are stacked on the paper stacking plate 60.

A sheet of paper T placed on the paper stacking plate 60 is sent into the paper conveying path L by a cassette paper feeding section 51 that is disposed at an end portion on a paper-feeding side of the paper cassette 52 (an end portion on the right side in FIG. 1). The cassette paper feeding section 51 is provided with a paper feeding mechanism composed of a pickup roller 61 for picking up the paper T from the paper stacking plate 60 and a paper feeding roller pair 63 for sending the paper T into the paper conveying path L on a sheet by sheet basis.

The apparatus main body M is provided with a manual paper feeding section 64 on the front side (the right side in FIG. 1) thereof. The provision of the manual paper feeding section 64 is mainly for the purpose of feeding the apparatus main body M with sheets of paper T having sizes or types different from those of the sheets of paper T set in the paper cassette 52. The manual paper feeding section 64 is provided with a manual paper feeding tray 65 constituting part of the front face of the apparatus main body M when the manual paper feeding tray 65 is closed, and a paper feeding roller 66. A lower edge of the manual paper feeding tray 65 is pivotably (openably and closably) attached to the vicinity of the paper feeding roller 66. The sheets of paper T are placed on the manual paper feeding tray 65 in an open state. The paper feeding roller 66 feeds the paper T placed on the manual paper feeding tray 65 in the open state into a manually-fed paper conveying path La.

The apparatus main body M is provided with a paper ejecting section 50 at an upper portion thereof. In the paper ejecting section 50, the paper T is ejected to outside the apparatus main body M by a third roller pair 53. Details of the paper ejecting section 50 will be described later.

The paper conveying path L through which the paper T is conveyed is provided with a first paper conveying path L1 extending from the cassette paper feeding section 51 to a transfer nip N, a second paper conveying path L2 extending from the transfer nip N to the fixing section 9, a third paper conveying path L3 extending from the fixing section 9 to the paper ejecting section 50, the manually-fed paper conveying path La that leads the paper T fed from the manual paper feeding section 64 into the first paper conveying path L1, and a return paper conveying path Lb where the paper conveyed from a downstream side to an upstream side through the third paper conveying path L3 is turned upside down and led back into the first paper conveying path L1 in an upside-down state.

Moreover, in the middle of the first paper conveying path L1, a first junction portion P1 and a second junction portion P2 are provided. In the middle of the third paper conveying path L3, a first branching portion Q1 is provided. The first junction portion P1 is where the manually-fed paper conveying path La joins the first paper conveying path L1. The second junction portion P2 is where the return paper conveying path Lb joins the first paper conveying path L1. The first branching portion Q1 is where the return paper conveying path Lb branches off the third paper conveying path L3, and the first branching portion Q1 has a first roller pair 54*a* and a second roller pair 54*b*. The first and second roller pairs 54*a* and 54*b* share a common roller.

In the middle of the first paper conveying path L1 (specifically, between the second junction portion P2 and the transfer roller 8), there are disposed a sensor for detecting the paper T, as well as a regist roller pair 80 for correcting skew (diagonal feeding) of the paper T, and for adjusting timing of feeding the paper T with respect to the formation of a toner image in the image forming section GK. The sensor is disposed immediately before the regist roller pair 80 in a conveying direction in which the paper T is conveyed (on an upstream side in the conveying direction). The regist roller pair 80 performs the skew correction and the timing adjustment based on detection-signal information received from the sensor, and conveys the paper T.

The return paper conveying path Lb is a paper conveying path provided for the purpose of causing another side (unprinted side) of the paper T that is a side opposite to a side on which printing has already been performed to face the photosensitive drum 2 in a case of performing a double-side printing on the paper T. Through the return paper conveying path Lb, it is possible to reverse and convey the paper T, which is conveyed from the first branching portion Q1 to the paper ejecting section 50 by the first roller pair 54*a*, back into the first paper conveying path L1 with the second roller pair 54*b*, and to convey the paper T to an upstream side of the regist roller pair 80 disposed upstream from the transfer roller 8. In the transfer nip N, a predetermined toner image is transferred onto the unprinted side of the paper T turned over through the return paper conveying path Lb.

The paper ejecting section 50 is provided at an end portion of the third paper conveying path L3. The paper ejecting section 50 is disposed at an upper side in the apparatus main body M. The paper ejecting section 50 is open toward the front side of the apparatus main body M (the right side in FIG. 1, the manual paper feeding section 64 side). In the paper ejecting section 50, the paper T conveyed through the third paper conveying path L3 is ejected by the third roller pair 53 to outside the apparatus main body M.

On the open side of the paper ejecting section 50, an ejected paper stacking section M1 is provided. The ejected paper stacking section M1 is provided at an upper face (exterior face) of the apparatus main body M. The ejected paper stacking section M1 is formed as a downward depression in the upper face of the apparatus main body M. A bottom face of the ejected paper stacking section M1 is formed of a top cover member M2 as an opening and closing member which constitutes part of the upper face of the apparatus main body M. Sheets of paper T having a predetermined toner image formed thereon and having been ejected from the paper ejecting section 50 are stacked on the upper face of the top cover member M2 where the ejected paper stacking section M1 is formed. It should be noted that a paper-detecting sensor (not shown) is disposed in a predetermined position of each paper conveying path.

In the image forming apparatus 1 of the present embodiment, as shown in FIG. 2, a member moving mechanism 100 operable in conjunction with opening and closing of the top cover member M2 is incorporated inside the apparatus main body M. A configuration of the member moving mechanism 100 will be described later in detail.

Next, a description will be given of an image forming operation of the image forming apparatus 1 of the present embodiment. In the image forming operation, first, in the image forming section GK, the charging section 10 uniformly charges the surface of the photosensitive drum 2, and then, based on image information received from an external device such as a personal computer (PC), the LSU 4 irradiates a laser beam (light rays) onto the surface of the photosensitive drum 2 to thereby form an electrostatic latent image thereon based on the image data. Thereafter, the developing device 16 causes toner to adhere to the electrostatic latent image to form a toner image.

Toward the image forming section GK where the toner image has been formed as described above, a sheet of paper T is conveyed from the paper cassette 52 (or the manual paper feeding tray 65), through the paper conveying path L and the regist roller pair 80 at a predetermined timing. In the image forming section GK, the toner image on the surface of the photosensitive drum 2 is transferred onto the sheet of paper T by the transfer roller 8. Subsequently, the sheet of paper T onto which the toner image has been transferred is removed from the photosensitive drum 2 to be conveyed to the fixing section 9, where heat and pressure are applied to the sheet of paper T, and thereby the toner image is fixed on the sheet of paper T.

In which way the sheet of paper T is to be conveyed after the fixing section 9 is determined by the first branching portion Q1. In a case where an image is formed on one side alone, the sheet of paper T is directly ejected by the third roller pair 53 through the paper ejecting section 50 onto the ejected paper stacking section M1.

On the other hand, in a case where an image is formed on each side of the sheet of paper T, the sheet of paper T is once conveyed toward the third roller pair 53 after passing through the fixing section 9, but after an rear edge of the sheet of paper T passes the first branching portion Q1, the third roller pair 53 is made to rotate reversely such that the sheet of paper T is led backward into the return paper conveying path Lb, to be conveyed back to the regist roller pair 80 with its sides turned over. Then, a next image formed on the photosensitive drum 2 is transferred onto the unprinted side of the sheet of paper T by the transfer roller 8, and then, after the sheet of paper T is conveyed to the fixing section 9 for the toner image to be fixed thereon, the sheet of paper T is ejected through the paper ejecting section 50 onto the ejected paper stacking section M1.

Figure 3:
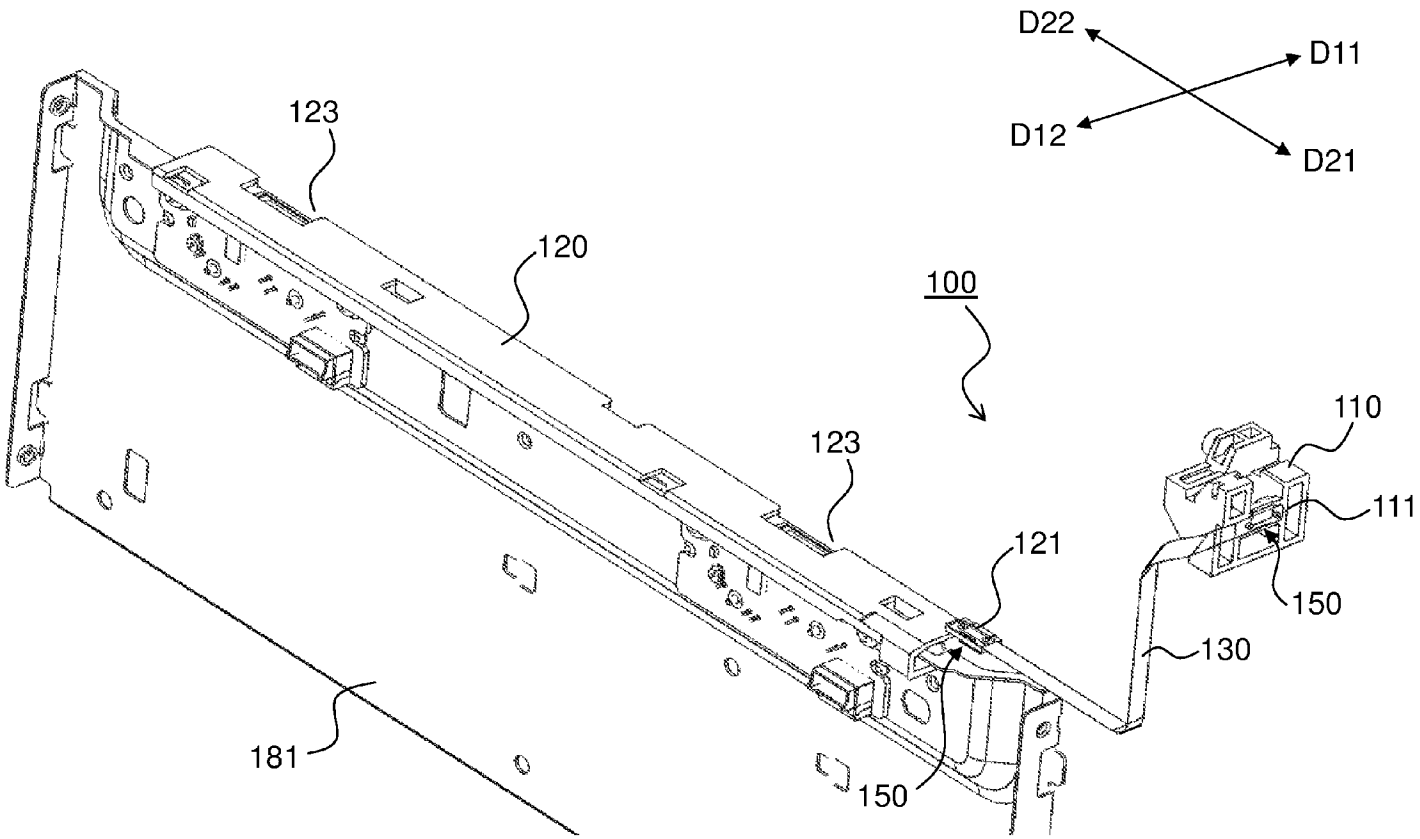
FIG. 3 is a perspective view showing an overall configuration of the member moving mechanism 100 according to a first embodiment of the present disclosure.
Figure 4:
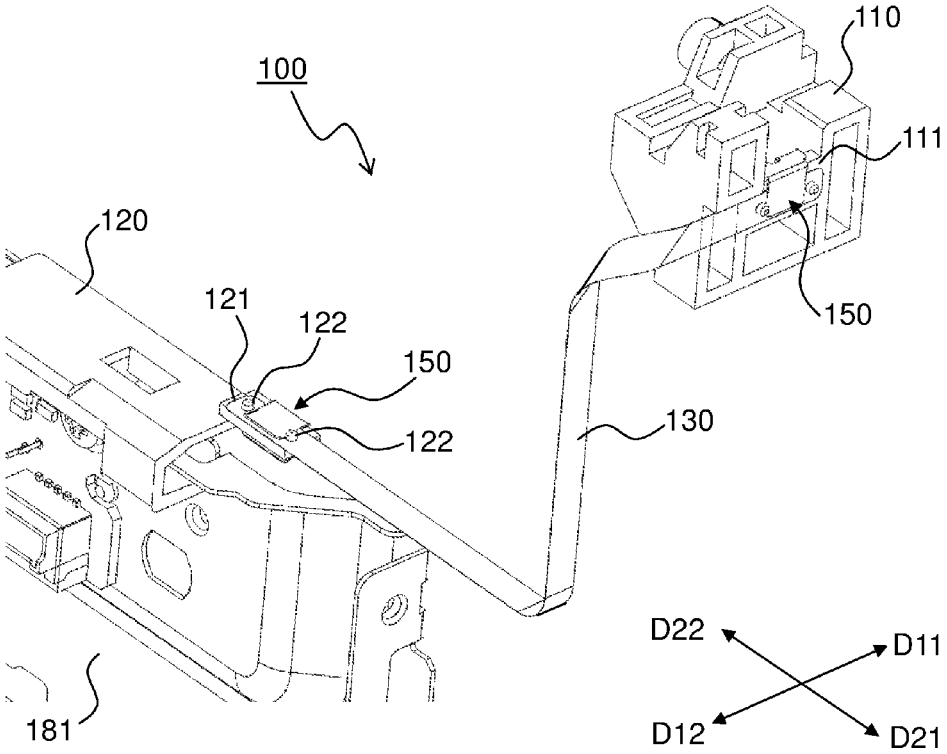
FIG. 4 is an enlarged perspective view of a principal part of the member moving mechanism 100 of the first embodiment.
Figure 5:
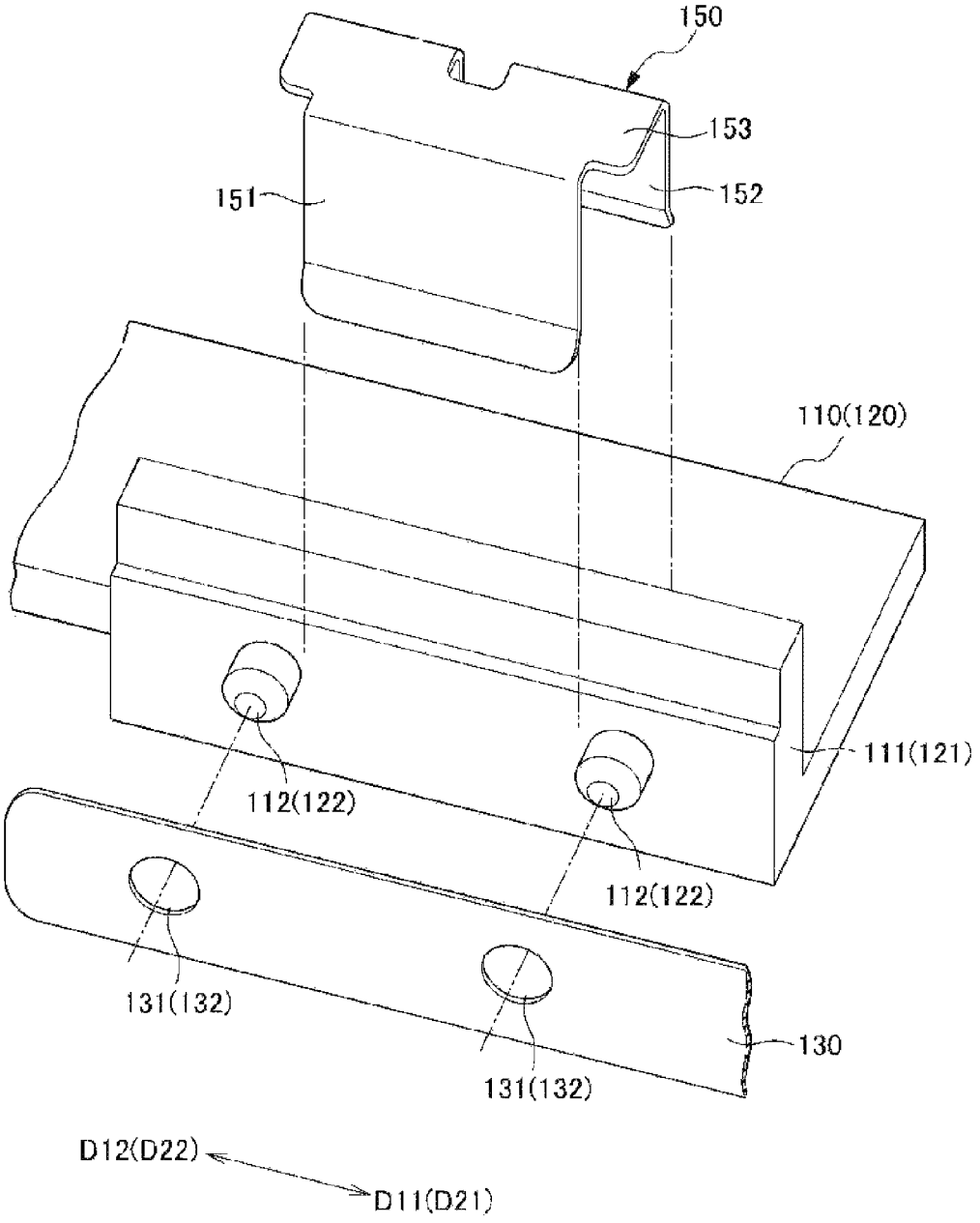
FIG. 5 is an exploded perspective view showing a principal part of a connecting section where a moving member 110 and a moved member 120 are connected to a belt member 130 in the member moving mechanism 100 of the first embodiment.
Figure 6:
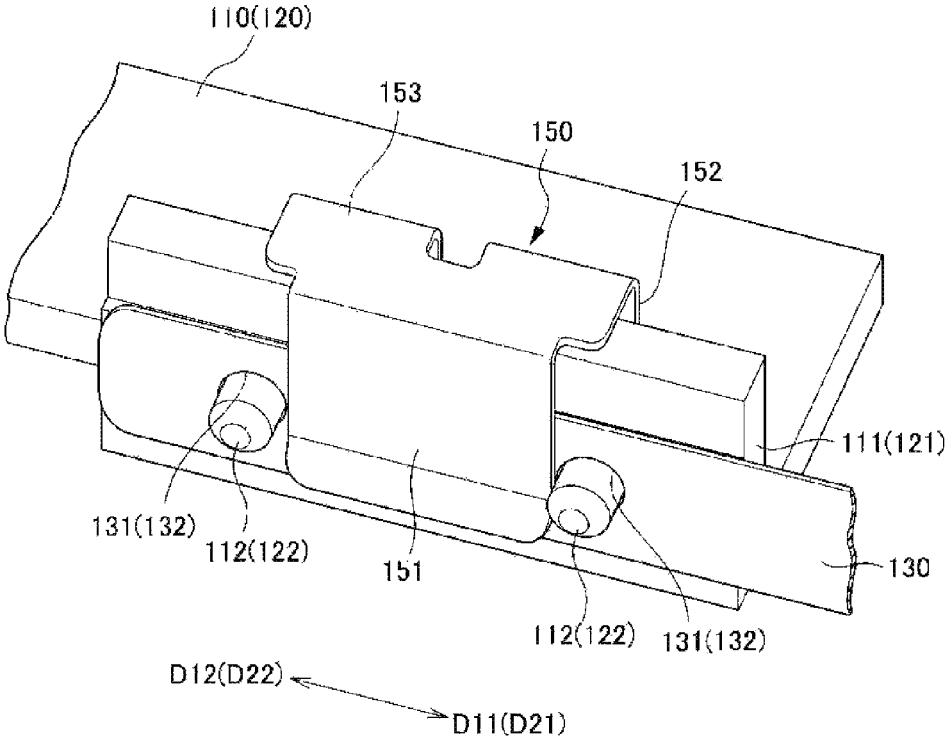
FIG. 6 is an enlarged perspective view showing, in an assembled (connected) state, the principal part of the connecting section where the moving member 110 and the moved member 120 are connected to the belt member 130 in the member moving mechanism 100 of the first embodiment.

FIG. 3 is a perspective view showing an overall configuration of the member moving mechanism 100 according to a first embodiment of the present disclosure. FIG. 4 is an enlarged perspective view of a principal part of the member moving mechanism 100 of the first embodiment. FIG. 5 is an exploded perspective view of the principal part showing, in an exploded state, a configuration of a connecting section where a moving member 110 and a moved member 120 are connected to a belt member 130 in the member moving mechanism 100 of the first embodiment. FIG. 6 is an enlarged perspective view of the principal part, showing, in an assembled (connected) state, the configuration of the connecting section where the moving member 110 and the moved member 120 are connected to the belt member 130 in the member moving mechanism 100 of the first embodiment.

As shown in FIG. 3 and FIG. 4, the member moving mechanism 100 is provided with the moving member 110, the moved member 120, the belt member 130, and a belt-member guide member 140 (see FIG. 9), which will be described later. The moving member 110 moves in a first positive direction D11 or in a first negative direction D12 which is opposite to the first positive direction D11.

The moved member 120 moves in directions different from both the first positive and negative directions D11 and D12, specifically, in a second positive direction D21 (which is a direction orthogonal to the first positive and negative directions D11 and D12) or in a second negative direction D22 which is opposite to the second positive direction D21.

The belt member 130 is a belt-shaped member connecting the moving member 110 to the moved member 120. The belt member 130 is formed of a flexible sheet material. As a result, it is possible to reduce the flexural radius of the belt member 130, and thus to insert and dispose the belt member 130 through a small gap or the like. Thus, it is possible to reduce the space for installing the belt member 130, and thus to achieve a compact member moving mechanism 100. Examples of the belt member 130 include a plastic member such as polyethylene terephthalate (PET), an elastic member such as rubber, and a metal member. A thickness of the belt member 130 is 1 mm or less, for example.

As shown in FIG. 5, at one longitudinal end portion of the belt member 130, two first holes 131 are provided to be spaced in the longitudinal direction. At the other longitudinal end portion of the belt member 130, two second holes 132 are provided to be spaced in the longitudinal direction. A connected portion 111 of the moving member 110 has two first protrusions 112 to be inserted in the first holes 131. A connected portion 121 of the moved member 120 has two second protrusions 122 to be inserted in the second holes 132.

It should be noted that the one end portion and the other end portion of the belt member 130 in its longitudinal direction have a similar configuration, and also, the connected portion 111 of the moving member 110 and the connected portion 121 of the moved member 120 have a similar configuration. Hence, in each of FIG. 5 and FIG. 6, the similarly configured portions are illustrated by the same figure.

In the one end portion of the belt member 130 in the longitudinal direction, to a connection portion between the belt member 130 and the connected portion 111 of the moving member 110, there is attached an elastically fittable connection retaining clip 150. Likewise, in the other end portion of the belt member 130 in the longitudinal direction, to a connection portion between the belt member 130 and the connected portion 121 of the moved member 120, there is attached another elastically fittable connection retaining clip 150.

The connection retaining clip 150 has the following: a first plate portion 151 that is in elastic contact with an exterior surface of the belt member 130 between the two first holes 131 or between the two second holes 132; a second plate portion 152 that is in elastic contact with an interior surface of the connected portion 111 or of the connected portion 121, and a plate connecting portion 153 that connects the plate portions 151 and 152 to each other. The connection retaining clips 150 are each formed by bending a spring plate material.

As shown in FIG. 6, the first protrusions 112 on the moving member 110 side are inserted in the first holes 131 of the belt member 130. Furthermore, the connection retaining clip 150 is elastically fitted to a portion where the connected portion 111 of the moving member 110 overlaps with the belt member 130, and thereby the moving member 110 is connected to the one end portion of the belt member 130, and this connection is retained. Likewise, the second protrusions 122 on the moved member 120 side are inserted in the second holes 132 of the belt member 130. Furthermore, the other connection retaining clip 150 is elastically fitted to a portion where the connected portion 121 of the moved member 120 overlaps with the belt member 130, and thereby the moved member 120 is connected to the other end portion of the belt member 130, and this connection is retained. In this way, the moving member 110 and the moved member 120 are connected to each other by the belt member 130.

With this configuration, a very simple connection is achieved between the moving member 110 and the belt member 130 and between the moved member 120 and the belt member 130 in terms of structure and assembly. Thus, it is possible to reduce production cost of the member moving mechanism 100 as a whole.

Next, descriptions will be given of a linkage structure between the top cover member M2 in the image forming apparatus 1 and the member moving mechanism 100 that operates in conjunction with the opening and closing of the top cover member M2, and of a linkage structure between the member moving mechanism 100 and a cleaning member 190 connected to the moved member 120 in the member moving mechanism 100.

Figure 7:
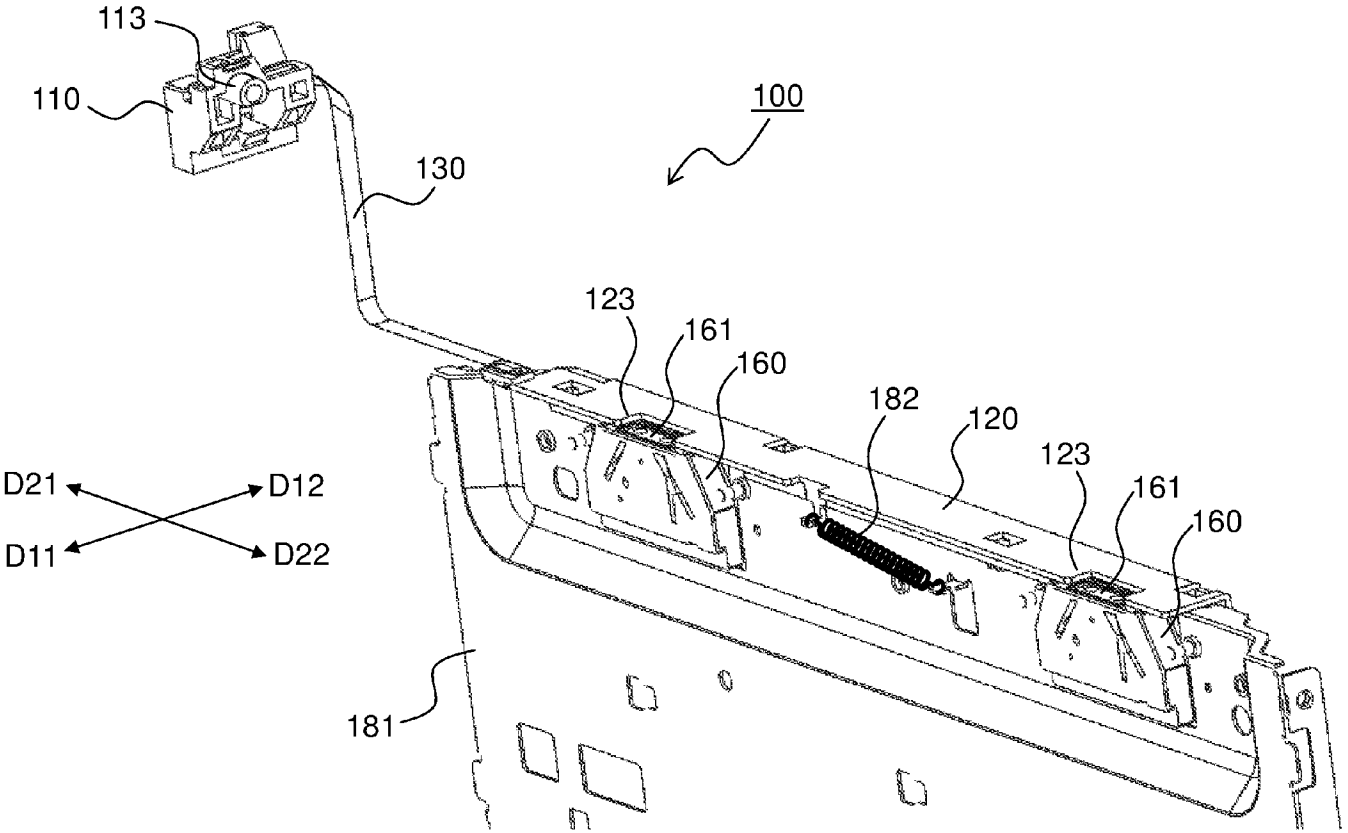
FIG. 7 is a perspective view showing the overall configuration of the member moving mechanism 100 of the first embodiment as seen from a side opposite to FIG. 3.
Figure 8:
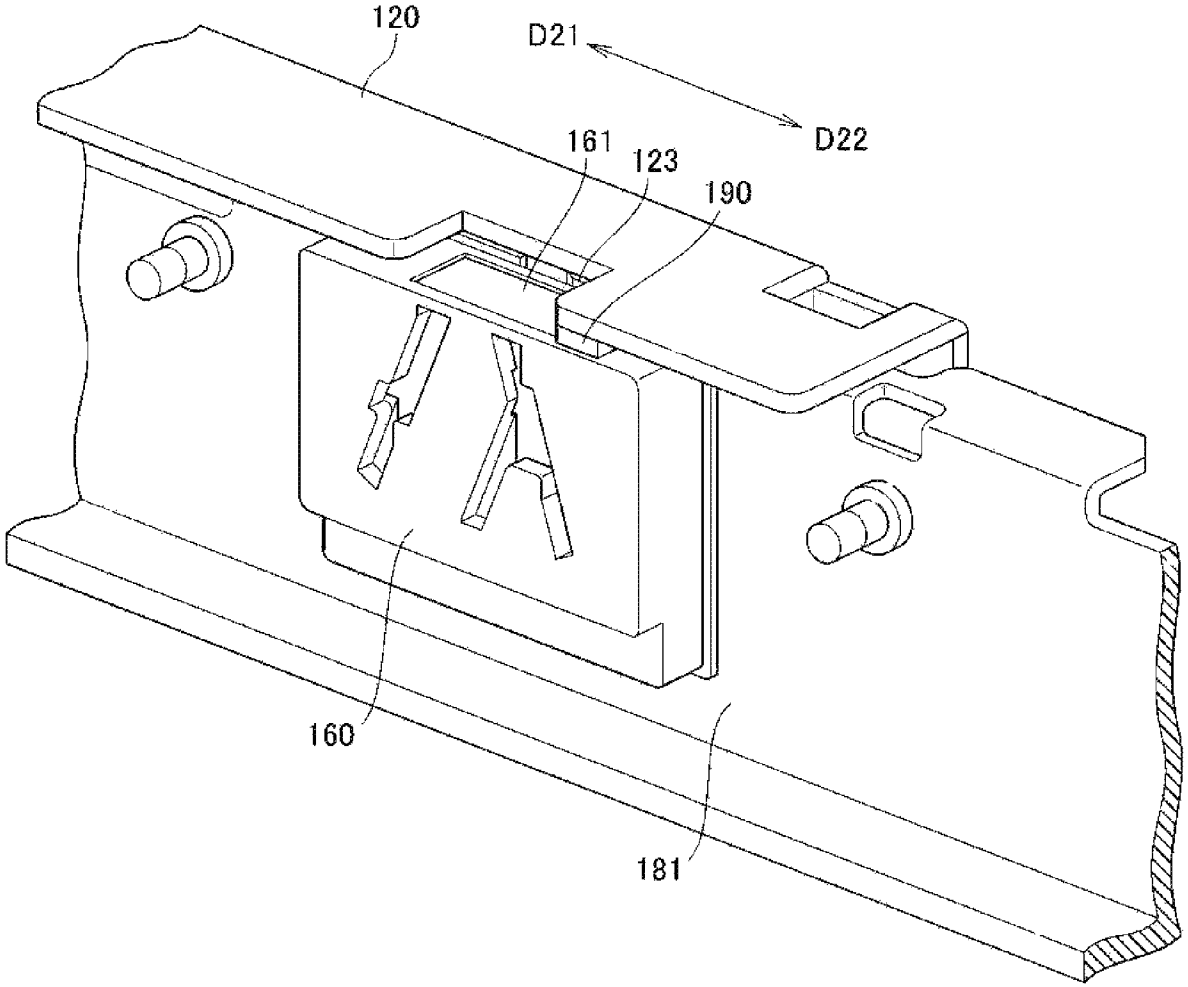
FIG. 8 is an enlarged perspective view of a principal part for illustrating a detailed configuration around a cleaning member 190 in the image forming apparatus 1.
Figure 9:
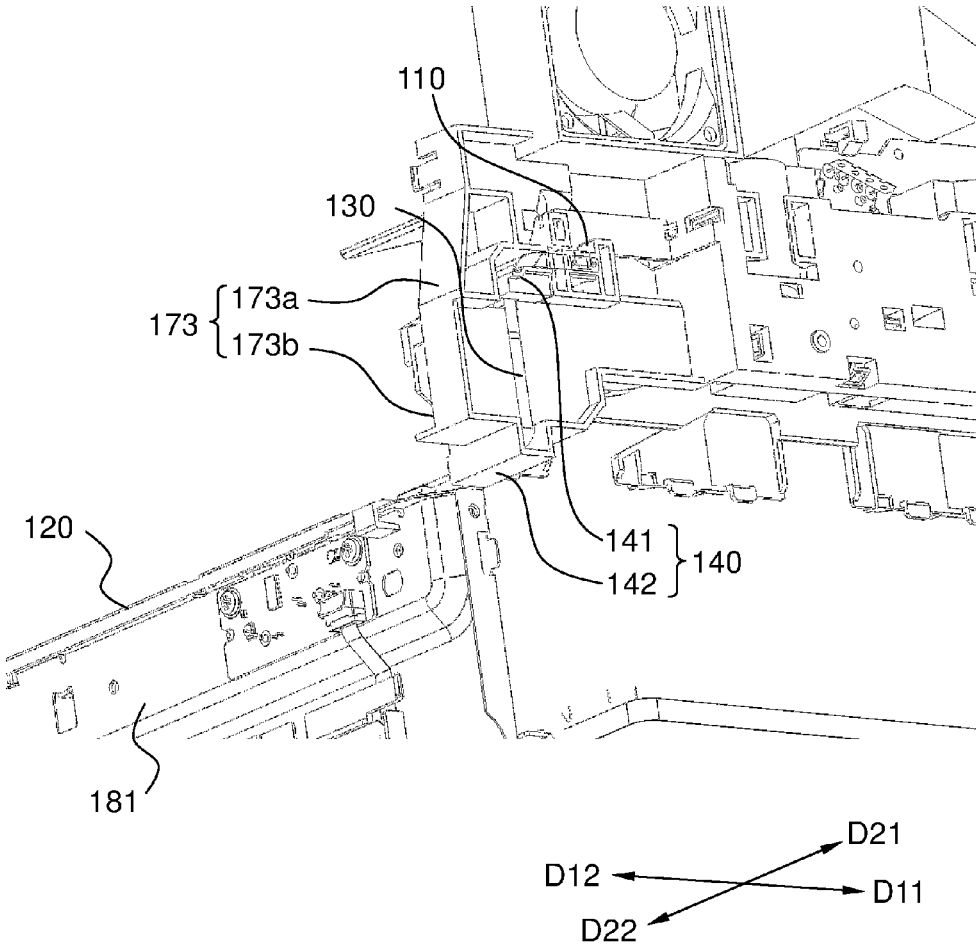
FIG. 9 is a perspective view showing details of a linkage structure between a top cover member M2 and the member moving mechanism 100 of the first embodiment in the image forming apparatus 1.
Figure 10:
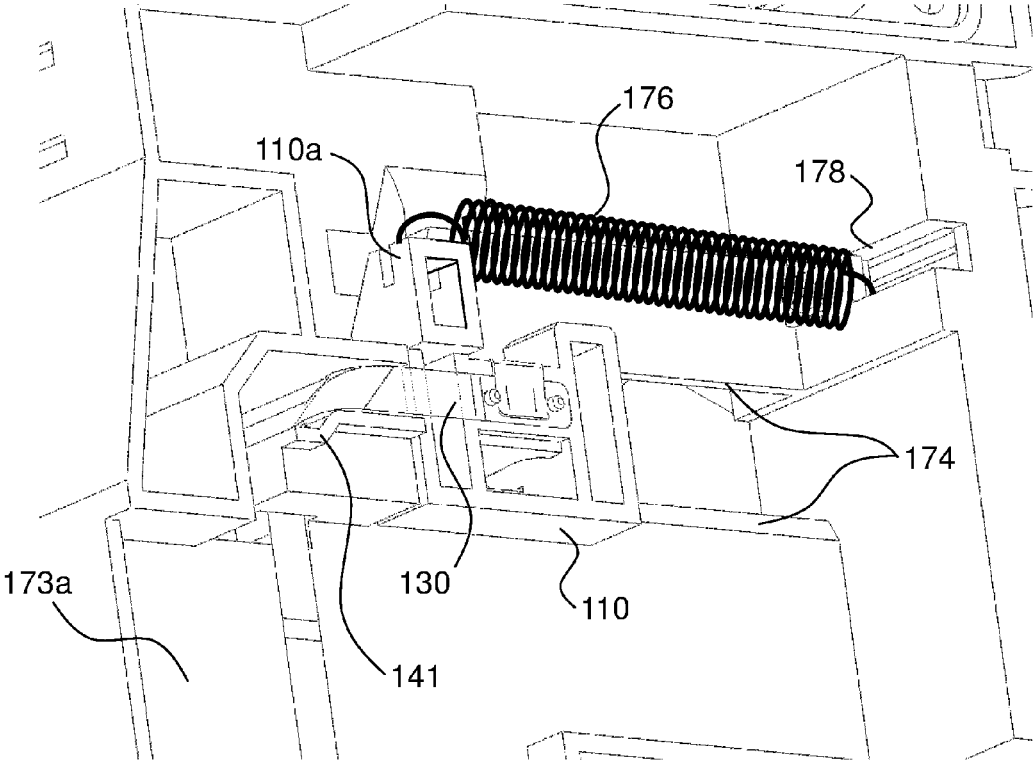
FIG. 10 is an enlarged perspective view of a principal part for illustrating a configuration around the moving member 110 in the member moving mechanism 100 of the first embodiment.
Figure 11:
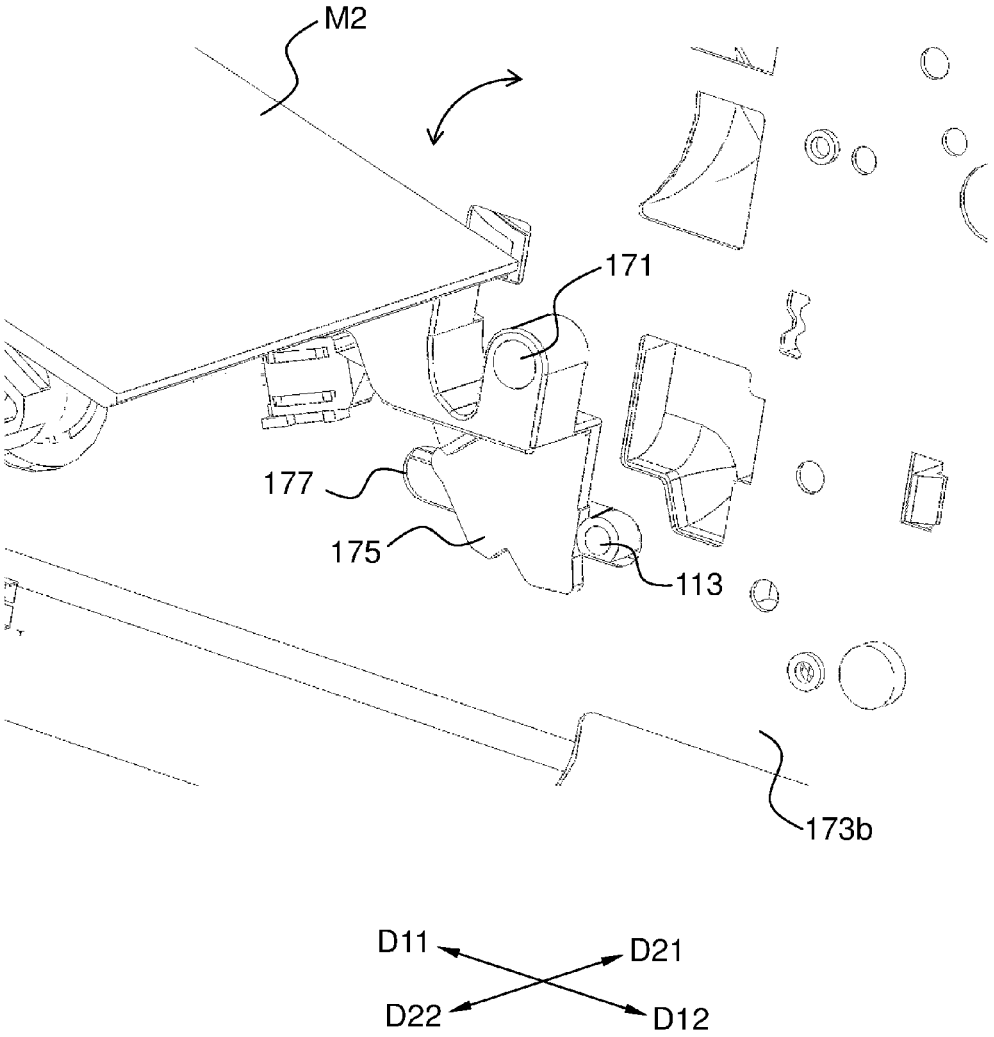
FIG. 11 is an enlarged perspective view showing a configuration for moving the moving member 110 of the member moving mechanism 100 of the first embodiment in a first positive direction D11 or a first negative direction D12 as seen from an interior frame 173*b* side.
Figure 12:
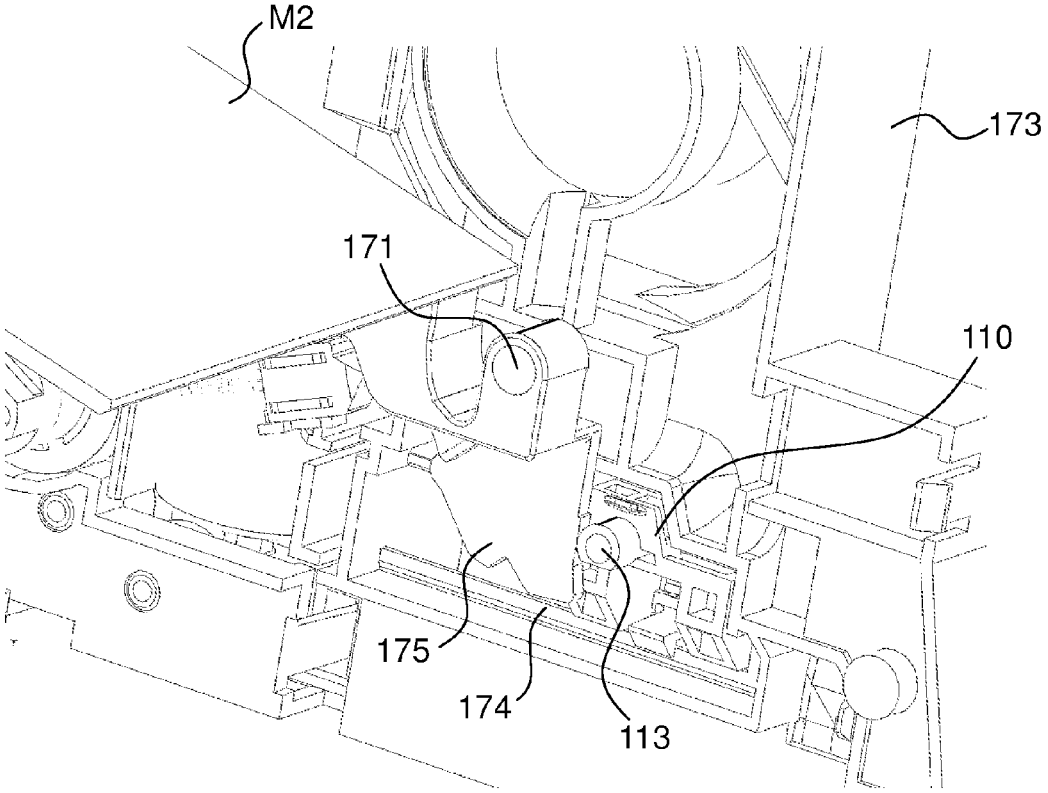
FIG. 12 is a perspective view showing a state after the interior frame 173*b* of a second stationary frame 173 is removed from the state shown in FIG. 11.

FIG. 7 is a perspective view showing an overall configuration of the member moving mechanism 100 of the first embodiment, as viewed from a side (from inside of the image forming apparatus 1) opposite to the side from which the member moving mechanism 100 is viewed in FIG. 3. FIG. 8 is an enlarged perspective view of a principal part for illustrating a detailed configuration around the cleaning member 190 in the image forming apparatus 1. FIG. 9 is a perspective view showing details of the linkage structure between the top cover member M2 and the member moving mechanism 100 of the first embodiment in the image forming apparatus 1. FIG. 10 is an enlarged perspective view of the principal part for illustrating a configuration around the moving member 110 in the member moving mechanism 100 of the first embodiment. FIG. 11 is an enlarged perspective view showing a configuration for moving the moving member 110 of the member moving mechanism 100 of the first embodiment in the first positive direction D11 or the first negative direction D12 as seen from an interior frame 173*b* side (back face side of FIG. 10). FIG. 12 is a perspective view showing a state after the interior frame 173*b* of a second stationary frame 173 is removed from the state shown in FIG. 11.

As shown in FIG. 7, the moved member 120 that has a shape of an elongated belt-shaped plate, and is slidably supported by a first stationary frame 181. The first stationary frame 181 constitutes part of a case body BD (the apparatus main body M). The first stationary frame 181 extends along the second positive direction D21 and the second negative direction D22 of the moved member 120. Between the first stationary frame 181 and the moved member 120, a first coil spring 182 is stretched as a first biasing member that applies a biasing force to the moved member 120. The first coil spring 182 permits the moved member 120 to move in the second positive direction D21 via the belt member 130 in conjunction with movement of the moving member 110 in the first positive direction D11. Moreover, the first coil spring 182 generates (charges), in conjunction with the movement of the moved member 120 in the second positive direction D21, a biasing force in such a direction as to cause the moved member 120 to move back in the second negative direction D22.

As shown in FIG. 7 and FIG. 8, an optical sensor 160 is attached to the first stationary frame 181. The optical sensor 160 is a sensor for detecting an image density, for example. The optical sensor 160 is fixed to the first stationary frame 181 such that a light transmitting window 161, which is a light transmitting member, is located over an upper face of the optical sensor 160.

The moved member 120 is provided with a cutout hole 123. The cutout hole 123 is provided in order not to block light emitted through the light transmitting window 161 of the optical sensor 160 when the moved member 120 is positioned at its original position (home position), that is, when the top cover member M2 is closed. The moved member 120 is provided with a wiper 190 that is attached, as a cleaning member, to a lower face of the moved member 120 in the vicinity of the cutout hole 123.

Since the member moving mechanism 100 is provided with the above configuration, in conjunction with the movement of the moved member 120 in the second positive direction D21 and the second negative direction D22, the wiper 190 moves back and forth in sliding contact with the light transmitting window 161 of the optical sensor 160 to clean the light transmitting window 161 as a target of cleaning.

On the other hand, as shown in FIG. 9, the second stationary frame 173 is composed of an exterior frame 173*a* and the interior frame 173*b*, and constitutes part of the case body BD (apparatus main body M). The belt-member guide member 140 is integral with the exterior frame 173*a* of the second stationary frame 173. The belt-member guide member 140 is in sliding contact with the belt member 130, and regulates a moving direction of the belt member 130 and changes the moving direction of the belt member 130 twice.

More specifically, the belt-member guide member 140 is constituted by an arc-shaped first guide member 141 and a second guide member 142 that is U-shaped in section. The first guide member 141 is in sliding contact with one face of the belt member 130 to turn the belt member 130 so as to change the moving direction of the belt member 130 by substantially 90 degrees, from a moving direction in which a back-face side of the belt member 130 moves horizontally in a position along a vertical plane to another moving direction in which a front-face side of the belt member 130 moves downward in a position along a vertical plane. The second guide member 142 is in sliding contact with one face of the belt member 130, and changes the moving direction of the belt member 130 by substantially 90 degrees, from a downward moving direction to a moving direction in which the front and back faces of the belt member 130 move horizontally in a position along a horizontal plane.

As shown in FIG. 10, between the moving member 110 and the exterior frame 173*a*, a second coil spring 176 is stretched as a second biasing member. One end of the second coil spring 176 is engaged with an engaging portion 110*a* of the moving member 110, and the other end of the second coil spring 176 is fixed to a spring fixing portion 178 of the exterior frame 173*a*. The biasing force of the second coil spring 176 is set to be larger than that of the first coil spring 182 (see FIG. 7). In the exterior frame 173*a*, a rail portion 174 composed of a pair of upper and lower rails is provided to extend along the first positive and negative directions D11 and D12.

As shown in FIG. 11, the top cover member M2 is provided with a rotation shaft 171. The rotation shaft 171 is rotatably supported by the second stationary frame 173. The top cover member M2 is opened and closed about the rotation shaft 171 as a rotation fulcrum with respect to the case body BD (apparatus main body M). Further, the top cover member M2 is provided with a substantially sector-shaped engaging piece 175 that is integral with the top cover member M2 and projects in a direction away from the top cover member M2 (downward direction in FIG. 11) such that the rotation shaft 171 is located between the engaging piece 175 and the top cover member M2.

As shown in FIG. 11 and FIG. 12, the moving member 110 is provided with a boss 113 projecting in a direction (the second negative direction D22) that is orthogonal to the first positive and negative directions D11 and D12.

As shown in FIG. 11, the interior frame 173*b* is provided with a guide hole 177 that is formed as an elongated hole in which the boss 113 is slidably engaged. The moving member 110 is held by and between the upper and lower rails of the rail portion 174 and the boss 113 is engaged in the guide hole 177, and thereby, the moving member 110 is supported by the second stationary frame 173 to be slidable in the first positive and negative directions D11 and D12. The boss 113 projects through the guide hole 177 to outside the interior frame 173*b*, and abuts the engaging piece 175 of the top cover member M2 on the first negative direction-D12 side (upstream side with respect to the opening direction of the top cover member M2) of the engaging piece 175.

Since the member moving mechanism 100 is configured as described above, in conjunction with rotation of the top cover member M2 in the opening direction (clockwise direction in FIG. 11), the biasing force of the second coil spring 176 causes the moving member 110 to move along the rail portion 174 in the first positive direction D11 with the boss 113 abutting the engaging piece 175. When the top cover member M2 rotates in the closing direction (the counter clockwise direction in FIG. 11), in conjunction therewith, the moving member 110 moves in the first negative direction D12 along the rail portion 174 against the biasing force of the second coil spring 176.

Next, with reference to FIGS. 7 to 12, a description will be given of operations of the member moving mechanism 100 of the present embodiment, as well as operations linked via the member moving mechanism 100 between opening and closing of the top cover member M2 and cleaning performed by the wiper 190.

When the top cover member M2 is in a closed state, the boss 113 of the moving member 110 is pressed by the engagement piece 175 to be located at one end (right end in FIG. 11) of the guide hole 177 against the biasing force of the second coil spring 176. In this state, the moved member 120 is kept in its original position (home position) by the biasing force of the first coil spring 182 as shown in FIG. 7 and FIG. 8. Thereby, the cutout hole 123 of the moved member 120 is located opposite the light transmitting window 161 of the optical sensor 160. Thus, light emitted through the light transmitting window 161 is not blocked, which allows the optical sensor 160 to successfully detect an image density.

In this state, when the top cover member M2 rotates in the opening direction (clockwise direction in FIG. 11) about the rotation shaft 171, the engaging piece 175 that is integral with the top cover member M2 also rotates in the clockwise direction in FIG. 11. As a result, the pressing force of the engaging piece 175 on the boss 113 is eliminated. At this time, the moving member 110 receives via the belt member 130 the biasing force of the first coil spring 182 in the first negative direction D12 as well as the biasing force of the second coil spring 176 in the first positive direction D11. Here, however, since the biasing force of the second coil spring 176 is set to be larger than that of the first coil spring 182, the moving member 110 is caused to move by the biasing force of the second coil spring 176 in the first positive direction D11 with the boss 113 abutting the engagement piece 175.

In conjunction with the movement of the moving member 110 in the first positive direction D11, the moved member 120, which is connected to the moving member 110 via the belt member 130, moves in the second positive direction D21. In conjunction with the moved member 120 thus moving in the second positive direction D21, the wiper 190 moves in the same direction (the second positive direction D21) to slide on, and thereby clean, the light transmitting window 161 of the optical sensor 160.

Further, in conjunction with the moved member 120 moving in the second positive direction D21, the first coil spring 182 is pulled and stretched. As a result, a biasing force is generated (charged) to move the moved member 120 in the second negative direction D22.

Then, when the top cover member M2 rotates in the closing direction (counterclockwise direction in FIG. 11) about the rotation shaft 171 from the open state, the engagement piece 175 also rotates in the counterclockwise direction in FIG. 11. As a result, the boss 113 is pressed by the engaging piece 175, and thereby, the moving member 110 moves in the first negative direction D12 against the biasing force of the second coil spring 176, with the boss 113 abutting the engaging piece 175.

In conjunction with movement of the moving member 110 in the first negative direction D12, the biasing force of the first coil spring 182 causes the moved member 120 to move in the second negative direction D22. In conjunction with the movement of the moved member 120 in the second negative direction D22, the wiper 190 moves in the same direction (the second negative direction D22) to slide on, and thereby clean, the light transmitting window 161 of the optical sensor 160 again.

As has been discussed above, according to the member moving mechanism 100 of the present embodiment, by adopting the belt member 130 that is excellent in flexibility as a member for connecting the moving member 110 to the moved member 120, it is possible to make it easier to avoid interference of the belt member 130 with various drive units and mechanisms such that the degree of freedom in installation of the belt member 130 is increased. Besides, since the bending direction of the belt member 130 is easily determined, it is easy to install the belt member 130 in assembling the member moving mechanism 100.

Moreover, the member moving mechanism 100 of the present embodiment includes the first coil spring 182 that applies a biasing force to the second moving member 120 in the second negative direction D22, and the second coil spring 176 that applies a biasing force to the moving member 110 in the first positive direction D11. With this configuration, a biasing force is applied to the belt member 130 in a pulling direction via the moving member 110, and thus, it is possible to reduce slack of the belt member 130.

Moreover, the first coil spring 182 is able to utilize movement of the moved member 120 in the second positive direction D21 to thereby generate (store) a biasing force to cause the moved member 120 to move back in the second negative direction D22. Thus, it is possible to provide a simple and very inexpensive structure of a drive section of the member moving mechanism 100 for moving the moving member 110 and the moved member 120 back and forth in positive and negative directions.

Moreover, in the member moving mechanism 100 of the present embodiment, the biasing force of the second coil spring 176 is set to be larger than that of the first coil spring 182. This allows the boss 113 of the moving member 110 to press the engaging piece 175 of the top cover member M2 in the first positive direction D11 (opening direction). And, when the top cover member M2 rotates in the opening direction, the moving member 110 is caused to move in the first positive direction D11 by the biasing force of the second coil spring 176; and when the top cover member M2 rotates in the closing direction, the moving member 110 moves in the first negative direction D12 against the biasing force of the second coil spring 176.

With this configuration, the second coil spring 176 applies a biasing force to the top cover member M2 in the opening direction via the moving member 110. As a result, the biasing force of the second coil spring 176 acts as an auxiliary force in opening the top cover member M2, and this helps reduce a burden on a user in the opening operation. Furthermore, the biasing force of the second coil spring 176 acts as a damper in closing the top cover member M2, and this helps improve user safety in the closing operation. Thus, there is no need of dedicatedly providing a member as an auxiliary force giving mechanism or as a damper, and this makes it possible to reduce the number of components and the cost of the image forming apparatus 1.

Moreover, the image forming apparatus 1 of the present embodiment includes the member moving mechanism 100, the top cover member M2, the optical sensor 160, and the wiper 190 that is connected to the moved member 120 in the member moving mechanism 100 and performs cleaning of the optical sensor 160 while moving in conjunction with the movement of the moved member 120 in the second positive direction D21. Also, the moving member 110 in the member moving mechanism 100 moves in the first positive direction D11 in conjunction with opening of the top cover member M2.

Thus, according to the image forming apparatus 1 of the present embodiment, for example, it is possible to move the wiper 190 via the moving member 110, the belt member 130, and the moved member 120 of the member moving mechanism 100 in conjunction with opening and closing of the top cover member M2 of the image forming apparatus 1 performed for replacement of the toner cartridge 5 or the like, to thereby clean the light transmitting window 161 of the optical sensor 160.

Since the optical sensor 160 is disposed inside the apparatus main body M, the required number of times (frequency) of cleaning of the light transmitting window 161 is not so great. Thus, according to the present embodiment, the light transmitting window 161 is cleaned in conjunction with opening and closing of the top cover member M2, which is generally performed a number of times (frequency) that is greater than the number of times (frequency) cleaning of the light transmitting window 161 is required to be performed. As a result, it is possible to eliminate need of providing a special moving mechanism for the wiper 190, and a mechanism for counting the number of times, or frequency, of the cleaning. Moreover, it is possible to clean the light transmitting window 161 of the optical sensor 160 securely and sufficiently without forgetting to.

Figure 13:
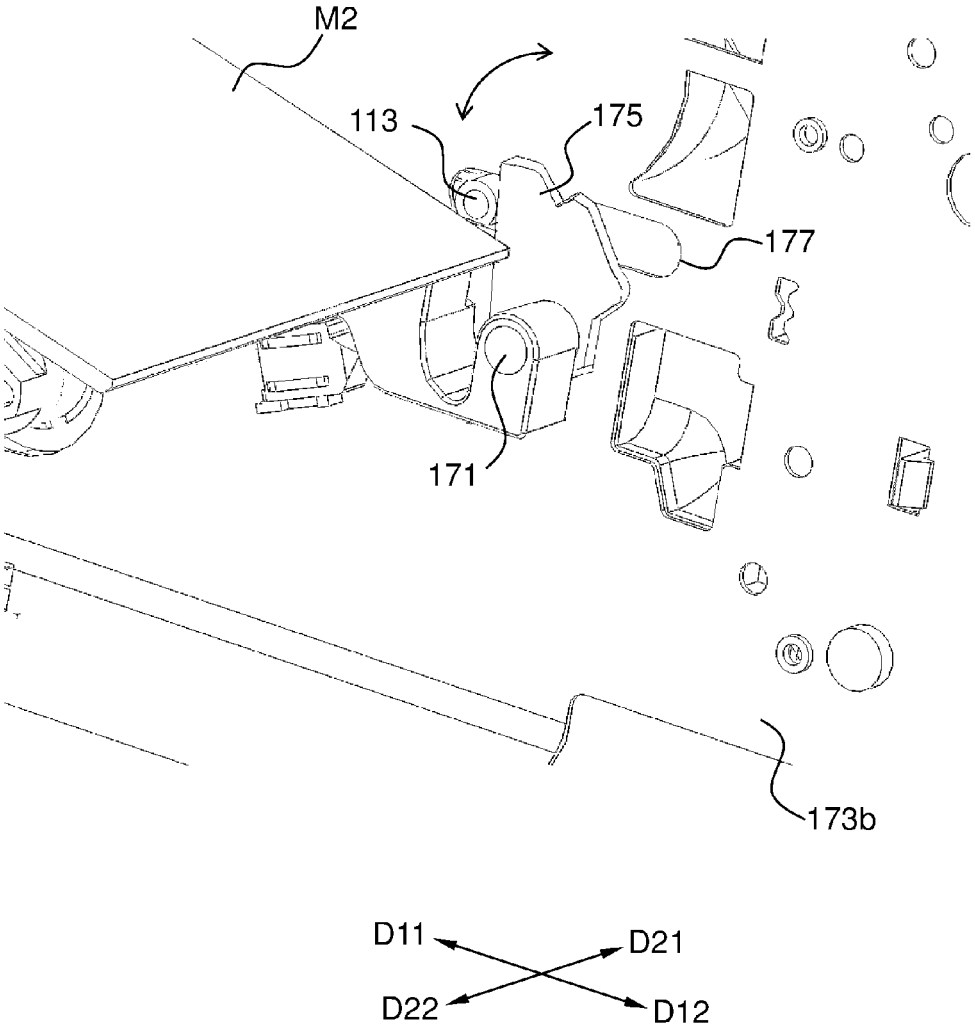
FIG. 13 is an enlarged perspective view showing a configuration for moving the moving member 110 of the member moving mechanism 100 of a second embodiment of the present disclosure in the first positive direction D11 or the first negative direction D12 as seen from the interior frame 173*b* side.

FIG. 13 is an enlarged perspective view showing, as seen from the interior frame 173*b* side, a configuration for moving the moving member 110 of the member moving mechanism 100 of a second embodiment of the present disclosure in the first positive direction D11 or the first negative direction D12. In the present embodiment, the engaging piece 175 projects in a direction (upward direction in FIG. 13) opposite to the direction in the first embodiment, and the guide hole 177 is disposed above the rotation shaft 171. The boss 113 of the moving member 110 which is slidably engaged with the guide hole 177 abuts the engaging piece 175 on the first positive direction-D11 side (upstream side with respect to the opening direction of the top cover member M2) of the engaging piece 175.

The second coil spring 176 is not provided, and the moving member 110 is biased by the first coil spring 182 (see FIG. 7) in the first negative direction D12. Thereby, the boss 113 presses the engaging piece 175 in the first negative direction D12.

In the member moving mechanism 100 of the present embodiment, the first coil spring 182, which applies a biasing force to the moved member 120 in the second negative direction D22, applies a biasing force to the moving member 110 in the first negative direction D12 via the belt member 130. And, by the boss 113 of the moving member 110 abutting the engaging piece 175 of the top cover member M2 on the first positive direction-D11 side of the engaging piece 175, movement of the moving member 110 in the first negative direction D12 is regulated. With this configuration, a biasing force in the pulling direction is continuously applied to the belt member 130, and this makes it possible to reduce slack of the belt member 130.

Furthermore, in the member moving mechanism 100 of the present embodiment, the boss 113 of the moving member 110 presses the engaging piece 175 of the top cover member M2 in the first negative direction D12. When the top cover member M2 rotates in the opening direction, the moving member 110 is caused to move in the first negative direction D12 by the biasing force of the first coil spring 182, and when the top cover member M2 rotates in the closing direction, the moving member 110 moves in the first positive direction D11 against the biasing force of the first coil spring 182.

With this configuration, the first coil spring 182 applies a biasing force in the opening direction, via the belt member 130 and the moving member 110, to the top cover member M2. As a result, the biasing force of the first coil spring 182 acts as an auxiliary force in opening the top cover member M2, and this helps reduce a burden on the user in the opening operation. Furthermore, the biasing force of the first coil spring 182 acts as a damper in closing the top cover member M2, and this helps improve user safety in the closing operation. Thus, as in the first embodiment, there is no need of dedicatedly providing a member as an auxiliary force giving mechanism or as a damper, and this makes it possible to reduce the number of components and the cost of the image forming apparatus 1.

It should be understood that the present disclosure is not limited to the above embodiments, and various modifications are possible within the scope of the present disclosure. For example, in the above embodiments, the member moving mechanism 100 is applied to link operations between the opening and closing of the top cover member M2 and the wiper 190, but this is not meant as a limitation, and the member moving mechanism 100 may be used for linking operations between, for example, the manual paper feeding section 64 and the wiper 190.

Furthermore, the belt-member guide member 140 may change the moving direction of the belt member 130 only once, or three or more times.

Moreover, the application of the present disclosure is not limited to a monochrome printer as shown in FIG. 1, but the present disclosure is applicable to various other image forming apparatuses that are provided with a member moving mechanism where one member is caused to move by movement of the other member, such as monochrome/color copiers, monochrome/color multifunction apparatuses, and color multifunction apparatuses and color printers provided with an inkjet image forming section.

The present disclosure is usable in a member moving mechanism where two members are connected to each other by a belt member such that one of the two members is caused to move by moving the other. By making use of the present disclosure, it is possible to make a biasing force of a first biasing member that serves to reduce slack of a belt member act as an auxiliary force in opening an openable-closable cover or as a damper in closing the openable-closable cover. Thus, it is not necessary to provide any dedicated members for such an auxiliary force or a damper, and this helps reduce the number of components and the cost.

What is claimed is:

1. A member moving mechanism, comprising:

a moving member that is movable in a first positive direction and a first negative direction that is opposite to the first positive direction;

a moved member that moves in a second positive direction that is different from both the first positive direction and the first negative direction in conjunction with movement of the moving member in the first positive direction, and that moves in a second negative direction that is opposite to the second positive direction in conjunction with movement of the moving member in the first negative direction;

a belt member that connects the moving member to the moved member;

a belt-member guide member that regulates a moving direction of the belt member;

an openable-closable cover that is rotatable about a rotation shaft in a state where the openable-closable cover is engaged with the moving member; and a first biasing member that biases the moved member in the second negative direction, the moving member being caused to move in the first negative direction by the biasing force of the first biasing member when the openable-closable cover rotates in an opening direction, the moving member moving in the first positive direction against the biasing force of the first biasing member when the openable-closable cover rotates in a closing direction, the openable-closable cover having an engaging piece projecting from the rotation shaft, the moving member having a boss abutting the engaging piece on a first-positive-direction side of the engaging piece, the boss applying a biasing force to the openable-closable cover in the opening direction by pressing the engaging piece in the first negative direction with the biasing force of the first biasing member.

2. The member moving mechanism of claim 1, wherein there is provided a frame member having:

a rail portion composed of a pair of rails extending along the first positive direction and the first negative direction; and an elongate guide hole in which the boss is slidably engaged; and the moving member is supported to be slidable in the first positive direction and the first negative direction by being held by and between the rails of the rail portion and by the boss being engaged in the guide hole.

3. The member moving mechanism of claim 2, wherein the engaging piece is formed to project in a same direction as the openable-closable cover with respect to the rotation shaft, and the guide hole is disposed above the rotation shaft; and the boss extends through the guide hole and abuts the engaging piece on the first-positive-direction side of the engaging piece.

4. The member moving mechanism of claim 1, wherein the belt-member guide member changes the moving direction of the belt member once or more.

5. An image forming apparatus, comprising:

the member moving mechanism of claim 1;

a cleaning member that is connected to the moved member constituting the member moving mechanism, and that moves in conjunction with movement of the moved member; and a cleaning-target member that is cleaned by the cleaning member.

* * * * *